US008702377B2

(12) United States Patent
Cottrell et al.

(10) Patent No.: US 8,702,377 B2
(45) Date of Patent: Apr. 22, 2014

(54) GAS TURBINE ENGINE ROTOR TIP CLEARANCE AND SHAFT DYNAMICS SYSTEM AND METHOD

(75) Inventors: Brian Cottrell, Litchfield Park, AZ (US); George Jerzy Zalewski, Scottsdale, AZ (US); James Kroeger, Tempe, AZ (US)

(73) Assignee: Honeywell International Inc., Morristown, NJ (US)

( * ) Notice: Subject to any disclaimer, the term of this patent is extended or adjusted under 35 U.S.C. 154(b) by 973 days.

(21) Appl. No.: 12/821,857

(22) Filed: Jun. 23, 2010

(65) Prior Publication Data

US 2011/0318162 A1 Dec. 29, 2011

(51) Int. Cl.
*F01D 5/26* (2006.01)

(52) U.S. Cl.
USPC ..... 415/119; 415/142

(58) Field of Classification Search
USPC ..... 415/119, 142
See application file for complete search history.

(56) References Cited

U.S. PATENT DOCUMENTS 3,396,905 A * 8/1968 Johnson ..... 415/119
3,613,457 A 10/1971 Davis et al.
3,980,358 A 9/1976 Davis
4,214,796 A 7/1980 Monzel et al.
4,429,923 A 2/1984 White et al.
4,705,410 A 11/1987 von Broock
4,743,125 A 5/1988 Dammel et al.
4,760,996 A 8/1988 Davis
4,781,363 A 11/1988 Braun
4,793,722 A 12/1988 Jensen
4,811,919 A 3/1989 Jones
4,848,525 A 7/1989 Jacot et al.
4,872,767 A 10/1989 Knapp
4,893,798 A 1/1990 Hibi et al.
4,952,076 A 8/1990 Wiley, III et al.
4,971,456 A 11/1990 Hori
4,971,458 A 11/1990 Carlson
5,004,215 A 4/1991 Aubry et al.
5,176,339 A 1/1993 Schmidt
5,201,585 A 4/1993 Gans et al.
5,219,051 A 6/1993 Davis
5,244,170 A 9/1993 Shekher
5,249,783 A 10/1993 Davis
5,305,981 A 4/1994 Cunningham et al.
5,318,156 A 6/1994 Davis
5,332,070 A 7/1994 Davis et al.
5,421,655 A 6/1995 Ide et al.
5,425,584 A 6/1995 Ide (Continued)

*Primary Examiner* — Nathaniel Wiehe
*Assistant Examiner* — Woody A Lee, Jr.
(74) *Attorney, Agent, or Firm* — Ingrassia Fisher & Lorenz, P.C.

(57) ABSTRACT

A gas turbine engine rotor tip clearance and shaft dynamics system and method are provided. The system includes a gas turbine engine that is disposed within an engine case and includes a rotor. A rotor bearing assembly disposed within the engine case rotationally mounts the gas turbine engine rotor. Vibration isolators mounted on the engine case are coupled to the rotor bearing assembly, and are configured to provide linear and independently tunable stiffness and damping. A method includes determining the location of a gas turbine engine rotor rotational axis, disposing the gas turbine engine rotor in an engine case at the rotational axis location, mounting a plurality of vibration isolators that include a plurality of adjustment devices on the engine case, coupling each vibration isolator to the gas turbine engine rotor, and locking the gas turbine engine rotor at the rotational axis location using the plurality of adjustment devices.

12 Claims, 5 Drawing Sheets

(56) References Cited

U.S. PATENT DOCUMENTS

| | | | | |
|---|---|---|---|---|
| 5,531,522 | A | 7/1996 | Ide et al. | |
| 5,603,574 | A | 2/1997 | Ide et al. | |
| 5,613,781 | A | 3/1997 | Kuzdzal et al. | |
| 5,738,445 | A | 4/1998 | Gardner | |
| 5,762,295 | A | 6/1998 | McGuire et al. | |
| 5,775,472 | A | 7/1998 | Osterberg et al. | |
| 5,797,684 | A | 8/1998 | Becker | |
| 5,803,213 | A | 9/1998 | Davis et al. | |
| 5,803,612 | A | 9/1998 | Battig | |
| 5,810,319 | A | 9/1998 | von Flotow et al. | |
| 5,816,373 | A | 10/1998 | Osterberg et al. | |
| 5,873,438 | A | 2/1999 | Osterberg et al. | |
| 5,918,865 | A | 7/1999 | Osterberg | |
| 5,947,240 | A | 9/1999 | Davis et al. | |
| 5,947,457 | A | 9/1999 | Swanson et al. | |
| 5,957,440 | A | 9/1999 | Jones et al. | |
| 5,974,782 | A | 11/1999 | Gerez | |
| 5,979,882 | A | 11/1999 | Osterberg | |
| 6,003,849 | A | 12/1999 | Davis et al. | |
| 6,036,182 | A | 3/2000 | Okanaka | |
| 6,065,741 | A | 5/2000 | Davis et al. | |
| 6,082,508 | A | 7/2000 | Davis | |
| 6,099,165 | A | 8/2000 | Tremaine | |
| 6,109,022 | A * | 8/2000 | Allen et al. | 60/223 |
| 6,109,791 | A | 8/2000 | Metton et al. | |
| 6,129,185 | A | 10/2000 | Osterberg et al. | |
| 6,155,720 | A | 12/2000 | Battig | |
| 6,212,974 | B1 | 4/2001 | Van Duyn | |
| 6,241,223 | B1 | 6/2001 | Gugsch et al. | |
| 6,293,532 | B2 | 9/2001 | McGuire | |
| 6,296,203 | B1 | 10/2001 | Manteiga et al. | |
| 6,354,576 | B1 | 3/2002 | Jacobs et al. | |
| 6,390,254 | B1 | 5/2002 | Bennett et al. | |
| 6,413,046 | B1 | 7/2002 | Penn et al. | |
| 6,415,674 | B1 | 7/2002 | Davis et al. | |
| 6,443,698 | B1 | 9/2002 | Corattiyil et al. | |
| 6,454,063 | B1 | 9/2002 | Osterberg et al. | |
| 6,540,483 | B2 | 4/2003 | Allmon et al. | |
| 6,634,472 | B1 | 10/2003 | Davis et al. | |
| 6,681,908 | B2 | 1/2004 | Davis | |
| 6,682,219 | B2 | 1/2004 | Alam et al. | |
| 6,715,591 | B2 | 4/2004 | Davis | |
| 6,755,287 | B2 | 6/2004 | Hadden et al. | |
| 6,834,841 | B2 | 12/2004 | Osterberg | |
| 6,851,529 | B2 | 2/2005 | Jones et al. | |
| 6,887,035 | B2 * | 5/2005 | Bruce | 415/160 |
| 6,955,250 | B2 | 10/2005 | Kreider et al. | |
| 7,012,271 | B2 | 3/2006 | Gorinevsky et al. | |
| 7,017,858 | B2 | 3/2006 | Roson et al. | |
| 7,051,617 | B2 | 5/2006 | Smith et al. | |
| 7,063,290 | B2 | 6/2006 | Marche | |
| 7,093,806 | B2 | 8/2006 | Osterberg | |
| 7,121,729 | B2 | 10/2006 | Davis et al. | |
| 7,182,188 | B2 | 2/2007 | Ruebsamen et al. | |
| 7,329,048 | B2 | 2/2008 | Klusman et al. | |
| 7,384,199 | B2 | 6/2008 | Allmon et al. | |
| 7,445,094 | B1 * | 11/2008 | Henderson et al. | 188/267 |
| 7,524,112 | B2 | 4/2009 | Gerez et al. | |
| 7,874,793 | B2 * | 1/2011 | Razzell et al. | 415/173.1 |
| 8,262,345 | B2 * | 9/2012 | Andrew | 415/159 |

* cited by examiner

GAS TURBINE ENGINE ROTOR TIP CLEARANCE AND SHAFT DYNAMICS SYSTEM AND METHOD

TECHNICAL FIELD

The present invention generally relates to gas turbine engines, and more particularly relates to systems and methods for improving the rotor tip clearance and shaft dynamics of gas turbine engine rotors.

BACKGROUND

For gas turbine engines, it is generally known that the operational clearances between the tips of rotating blades and engine static structure impact the thermodynamic efficiency and fuel burn of the engine. Hence, gas turbine engine manufacturers continually seek ways to reduce these operational clearances. The value of even several thousandths of an inch improvement can be quite significant, especially in the high pressure turbine and high pressure compressor. As a result, many gas turbine engine manufacturers trade markedly higher manufacturing costs in exchange for small improvements in blade tip clearance. These costs can be embedded in complex design features, in high precision manufacturing tolerances, and exotic build processes as a means to achieve reduced blade tip clearance. Despite such efforts, typically two to five thousandths of an inch in tip clearance is needed to accommodate geometric uncertainty in the location of the rotor centerline with respect to key locations on the static structure.

In addition to the operational clearances described above, gas turbine engine rotor dynamics receive great attention during engine design. This includes the placement of shaft critical speed in the frequency domain, and the rotor response to imbalance and transient excursions through critical speeds. Critical speed placement is controlled primarily via stiffness in the rotor/bearing support, while rotor response to imbalance and transient critical speed operation is controlled via damping. Typically, damping and stiffness control are provided via hydraulic devices, such as "squeeze film dampers" (SFDs), at rotor bearing locations. As is generally known, SFDs achieve both stiffness and damping via the whirl motion of the shaft within a controlled oil film annulus. However, both the stiffness and the damping coefficient achieved are highly non-linear with respect to orbital (whirl) displacement of the shaft. Moreover, the stiffness and damping coefficients are inexorably linked, which means one cannot be modified without a large effect on the other. This results in an inability to precisely locate and control response to critical speeds, since stiffness and damping are varied along with whirl displacement. This variability and imprecision causes manufacturers to design gas turbine engines with substantial frequency margin above running speeds for shaft bending mode critical speeds, and with having to accept some uncertainty in the placement and response of rigid rotor modes, which are commonly traversed in transient speeds during start and shutdown.

The net effect of the tip clearance and shaft dynamics issues described above can result in reduced efficiency and increased product cost, with additional costs embedded in a reduced yield in the assembly/test process due to the incidences of engines failing to meet specifications for temperature or vibration.

Hence, there is a need for a rotor tip clearance and shaft dynamics system and methods for gas turbine engines that provides increased efficiency and reduced operational and manufacturing costs. The present invention addresses at least this need.

BRIEF SUMMARY

In one exemplary embodiment, a gas turbine engine rotor tip clearance and shaft dynamics system includes an engine case, a gas turbine engine, a rotor bearing assembly, and a plurality of vibration isolators. The gas turbine engine is disposed within the engine case and includes a rotor. The rotor bearing assembly is disposed within the engine case and rotationally mounts the gas turbine engine rotor therein. Each of the vibration isolators is mounted on the engine case and is coupled to the rotor bearing assembly, and each vibration isolator is configured to provide linear and independently tunable stiffness and damping.

In another embodiment, a gas turbine engine rotor tip clearance and shaft dynamics system includes an engine case, a gas turbine engine, a rotor bearing assembly, a plurality of vibration isolators, a plurality of actuators, and an actuator control. The gas turbine engine is disposed within the engine case and includes a rotor. The rotor bearing assembly is disposed within the engine case and rotationally mounts the gas turbine engine rotor therein. Each of the vibration isolators is mounted on the engine case and is coupled to the rotor bearing assembly, and each vibration isolator is configured to provide linear and independently tunable stiffness and damping. Each actuator is coupled to one of the vibration isolators and is coupled to receive actuation control signals. Each actuator is responsive to the actuation control signals it receives to actively control gas turbine engine rotor position and dynamics. The actuator control is operable to selectively supply the actuation control signals to each actuator.

In yet another embodiment, a method of disposing a gas turbine engine rotor that has a rotational axis about which it rotates during operation in an engine case is provided. The method includes determining a location of the rotational axis of the gas turbine engine rotor within the engine case, and disposing the gas turbine engine rotor at the location of the rotational axis. A plurality of vibration isolators are mounted on the engine case, with each vibration isolator including a plurality of adjustment devices. Each of the vibration isolators is coupled to the gas turbine engine rotor, and the gas turbine engine rotor is locked at the location of the rotational axis using the plurality of adjustment devices.

Furthermore, other desirable features and characteristics of the gas turbine engine rotor tip clearance and shaft dynamics system and method will become apparent from the subsequent detailed description and appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description. In this regard, although various embodiments are described herein, for convenience of depicting a specific embodiment, as being implemented in a multi-spool turbofan gas turbine engine, it will be appreciated that embodiments of the system and method may be implemented in any one of numerous other machines that have rotationally mounted rotors.

Figure 1:
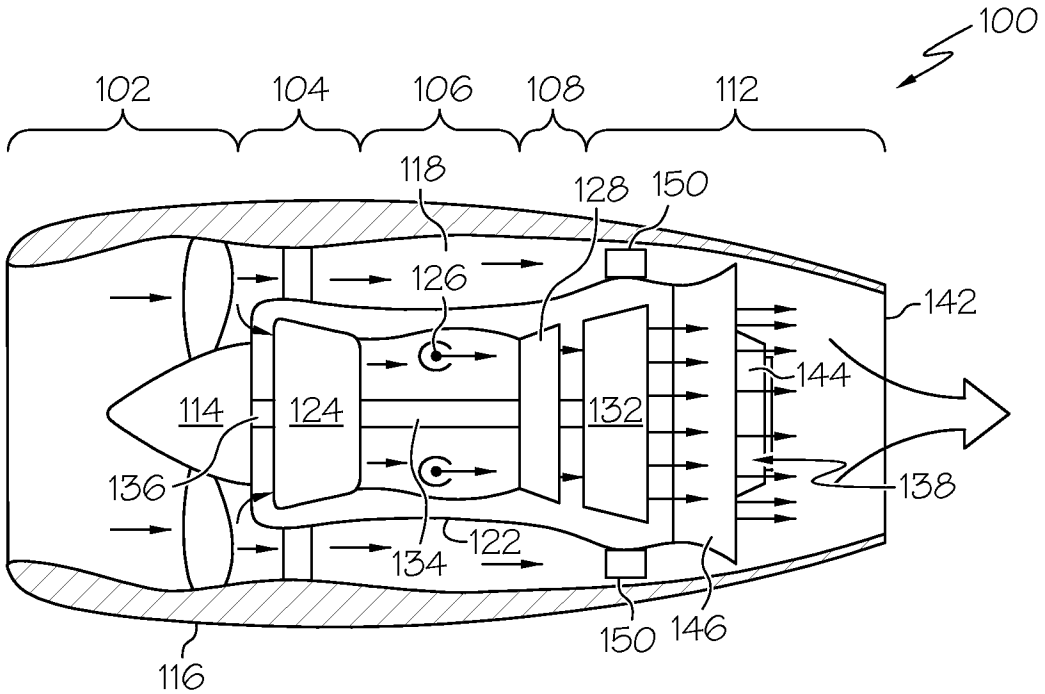
FIG. 1 depicts a functional block diagram of an exemplary turbofan gas turbine engine.

Turning now to FIG. 1, a functional block diagram of an exemplary turbofan gas turbine engine is depicted. The depicted engine 100 is a multi-spool turbofan gas turbine propulsion engine, and includes an intake section 102, a compressor section 104, a combustion section 106, a turbine section 108, and an exhaust section 112. The intake section 102 includes an intake fan 114, which is mounted in a nacelle assembly 116. The intake fan 114 draws air into the intake section 102 and accelerates it. A fraction of the accelerated air exhausted from the intake fan 114 is directed through a bypass flow passage 118 defined between the nacelle assembly 116 and an engine case 122. This fraction of air flow is referred to herein as bypass air flow. The remaining fraction of air exhausted from the intake fan 114 is directed into the compressor section 104.

The compressor section 104 may include one or more compressors 124, which raise the pressure of the air directed into it from the intake fan 114, and direct the compressed air into the combustion section 106. In the depicted embodiment, only a single compressor 124 is shown, though it will be appreciated that one or more additional compressors could be used. In the combustion section 106, which includes a combustor assembly 126, the compressed air is mixed with fuel supplied from a non-illustrated fuel source. The fuel and air mixture is combusted, and the high energy combusted fuel/air mixture is then directed into the turbine section 108.

The turbine section 108 includes one or more turbines. In the depicted embodiment, the turbine section 108 includes two turbines, a high pressure turbine 128, and a low pressure turbine 132. However, it will be appreciated that the engine 100 could be configured with more or less than this number of turbines. No matter the particular number, the combusted fuel/air mixture from the combustion section 106 expands through each turbine 128, 132, causing it to rotate. As the turbines 128 and 132 rotate, each drives equipment in the engine 100 via concentrically disposed rotors or spools. Specifically, the high pressure turbine 128 drives the compressor 124 via a high pressure rotor 134, and the low pressure turbine 132 drives the intake fan 114 via a low pressure rotor 136. Though not visible in FIG. 1, the high pressure rotor 134 and low pressure rotor 136 are each rotationally supported by a plurality of bearing assemblies. In particular, each rotor 134, 136 is preferably rotationally supported by a forward bearing and an aft bearing. The gas exhausted from the turbine section 108 is then directed into the exhaust section 112.

The exhaust section 112 includes a mixer 138 and an exhaust nozzle 142. The mixer 138 includes a centerbody 144 and a mixer nozzle 146, and is configured to mix the bypass air flow with the exhaust gas from the turbine section 108. The bypass air/exhaust gas mixture is then expanded through the propulsion nozzle 142, providing forward thrust.

Figure 2:
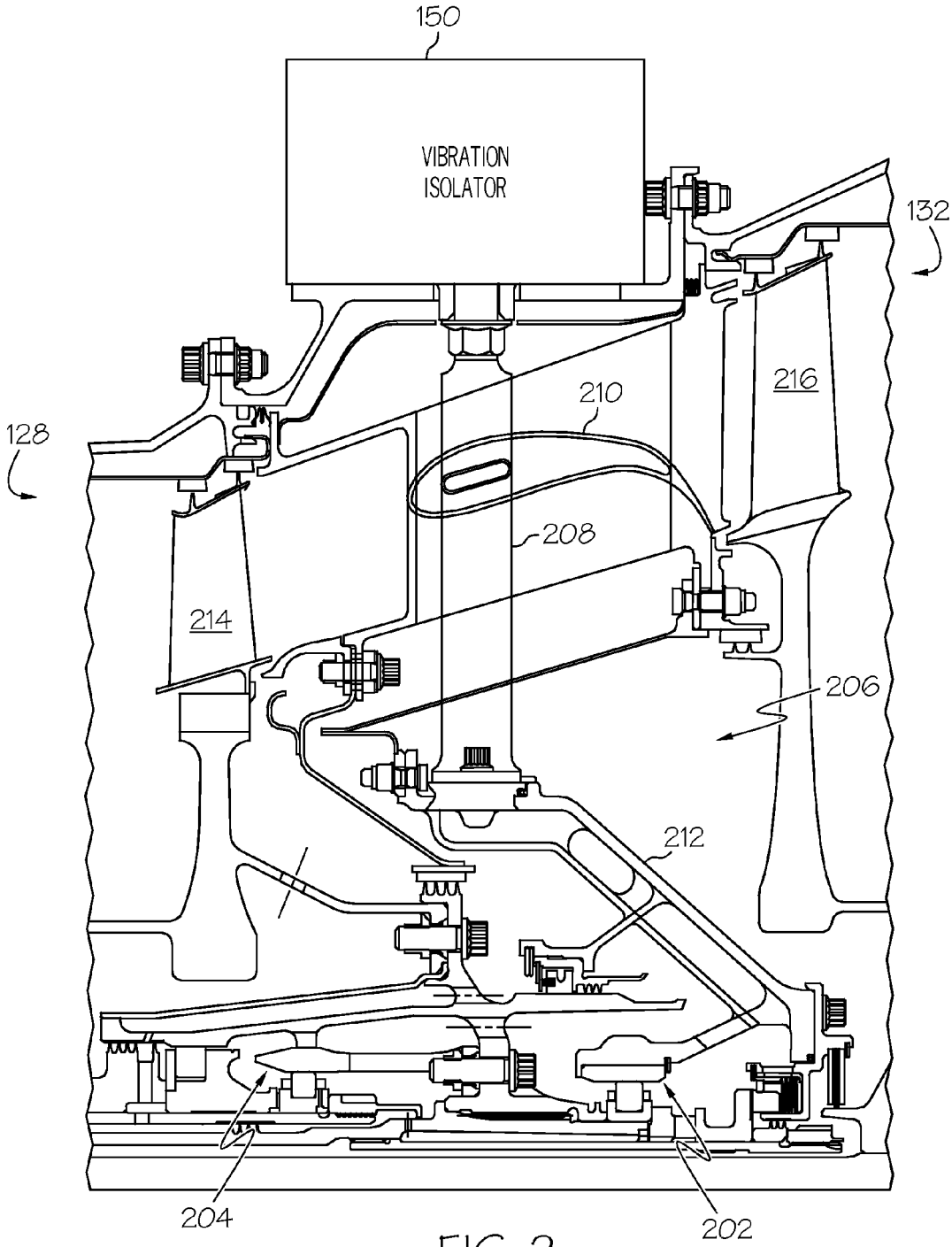
FIG. 2 depicts a close-up cross section view of a portion of an exemplary turbofan gas turbine engine that may represented by the functional block diagram of FIG. 1.

As FIG. 1 additionally depicts, a plurality of vibration isolators 150 are mounted on the engine case 122. The vibration isolators 150, which are preferably coupled to one or more of the non-illustrated rotor bearing assemblies, are each configured to provide linear and independently tunable stiffness and damping. The vibration isolators 150 also allow the gas turbine engine rotors 134, 136 to be precisely disposed within the engine case 122. With reference now to FIG. 2, the manner in the vibration isolators 150 is coupled to the rotor bearing assemblies is depicted and will be described.

The vibration isolators 150, as just noted, are each coupled to one or more rotor bearing assemblies. In the depicted embodiment, the vibration isolators 150 are each coupled to the low pressure rotor aft bearing assembly 202 and the high pressure rotor aft bearing assembly 204 via support structure 206. The configuration and implementation of the support structure 206 may vary, but in the depicted embodiment the support structure includes a strut 208 that traverses the gas path between the high pressure turbine 128 and the low pressure turbine 132. More specifically, each of the struts 208 extends through a stationary blade 210 that is disposed between rotating turbine blades 214 and 216 of the high pressure turbine 128 and the low pressure turbine 132. The strut 208 is in turn coupled to the rotor bearing assemblies 202, 204 via bearing support structure 212. It will be appreciated that the bearing support structure 212 may be preexisting, conventional bearing support structure or bearing support structure designed, configured, and implemented for use with the vibration isolators 150. It will additionally be appreciated that the vibration isolators 150 may be used to additionally or instead support other gas turbine engine components, such as the compressor 124.

Figure 3:
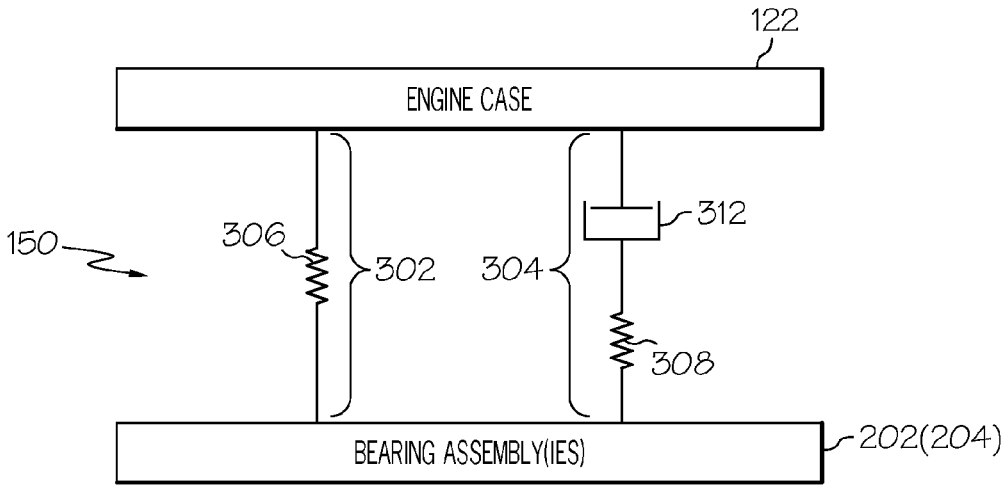
FIG. 3 depicts a schematic representation of a vibration isolator that may be used with the gas turbine engine of FIGS. 1 and 2 to implement an embodiment of a gas turbine engine rotor tip clearance and shaft dynamics system.

The vibration isolators 150 are preferably implemented using any one of the numerous three-parameter vibration isolator configurations that implement the functionality of the D-Strut™ vibration isolator, manufactured by Honeywell International, Inc. of Morristown, N.J. For completeness, a schematic representation of a D-Strut™ vibration isolator is depicted in FIG. 3, and with reference thereto is seen to include a first load path 302 and a second load path 304. The first load path 302 includes a first linear spring mechanism 306. The second load path 304 is disposed in parallel with the first load path 302 and includes a second linear spring mechanism 308 connected in series with a damper mechanism 312. When installed in the gas turbine engine 100, the first and second load paths 302, 304 are both coupled between the rotor bearing assemblies 202, 204 and the engine case 122.

Figure 4:
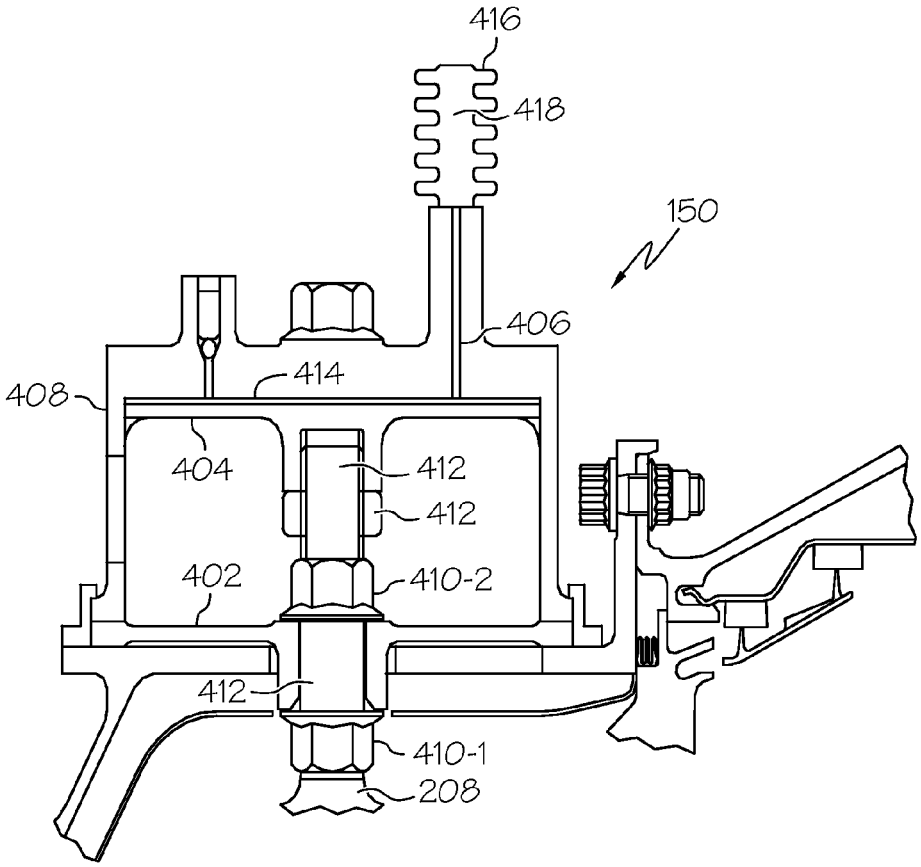
FIG. 4 depicts an embodiment of a physical implementation of a vibration isolator that may be used with the gas turbine engine of FIGS. 1 and 2 and that is represented by the diagram depicted in FIG. 3.

Turning now to FIG. 4, one example of a physical embodiment of a vibration isolator 150 that implements the schematically illustrated D-Strut™ functionality illustrated in FIG. 3, and that may be used with the gas turbine engine 100 of FIGS. 1 and 2, is depicted. The vibration isolator 150 includes a first flexural member 402, a second flexural member 404, an orifice 406, and a housing assembly 408. The first and second flexural members 402, 404 are both coupled, via adjustment devices 410-1, 410-2 and connection hardware 412, to the strut 208 and thus to the rotor bearing assemblies 202, 204. The second flexural member 404 and the housing assembly 408 are spaced apart from each other to define a fluid cavity 414. The fluid cavity 414 is in fluid communication with the orifice 406, which extends through housing assembly 408 and is in fluid communication with a fluid reservoir 416. Preferably, a suitable incompressible hydraulic fluid 418 is disposed within the fluid reservoir 416, and fills the orifice 406 and the fluid cavity 414.

Referring now to FIGS. 3 and 4 in combination, it is noted that the first and second flexural members 402, 404, which exhibit independent spring constants, together implement the functionality of the first linear spring mechanism 306. The volumetric stiffness of the fluid cavity 414, which is characterized by the second flexural element 404, the housing assembly 408, and the hydraulic fluid 418, implements the functionality of the second linear spring mechanism 308. And the orifice 406 and hydraulic fluid 418 together implement the functionality of the damper mechanism 312.

The configuration of the vibration isolator 150 depicted and described herein is such that at relatively low speeds, the first linear spring element 306 (e.g., the first and second flexural members 402, 404) is deflected by motion at the rotors 134, 136, and the hydraulic fluid 418 is readily forced through the orifice 406 between the fluid cavity 414 and the fluid reservoir 416, thereby decoupling the second linear spring element 308. Thus, at relatively low speeds the vibration isolator 150 behaves as a simple, optimal, linear spring. However, as speed increases, the load needed to force the hydraulic fluid 418 through the orifice 406 increases, which causes fluid pressure to begin to deflect the second flexural member 404. This effectively begins to reintroduce the second linear spring element 308, and also provides damping so long as fluid motion through the orifice 406 continues. As speed continues to increase, the force needed to rapidly force fluid through the orifice 406 increases to such a level that the hydraulic fluid 418 effectively acts as a solid. This causes the second linear spring element 308 (e.g., the volumetric stiffness of the fluid cavity 414 and the hydraulic fluid 418) to deflect exactly as the first linear spring element 306, effectively transitioning the vibration isolator 150 into a system with the first and second linear spring elements 306, 308 in parallel, without any damping.

The gas turbine engine 100 and vibration isolators 150 depicted in FIGS. 1-4 and described above implement a rotor tip clearance and shaft dynamics system that is wholly passive. It is noted, however, that the external location of the vibration isolators 150 and its various mechanical features for controlling rotor position and rotor dynamics provides for the use of active controls. In particular, active control of the rotor bearing assembly 202, 204 radial position(s) may be implemented via numerous and varied forms of active control of features associated with the vibration isolators 150. Such active controls may be used to target reduced rotor deflections and bearing loads under numerous forms of internally or externally produced excitation, both dynamic and static, such as imbalance or maneuver-based g-forces, throughout the operating speed range. For example, during relatively severe aircraft maneuvers, during which the rotors 134, 136 may otherwise be displaced within the engine case 122, active controls could simply adjust the position(s) of the rotor(s) 134 and/or 136 relative to the engine case 122, to compensate for the deflections produced by maneuver forces.

Figure 5:
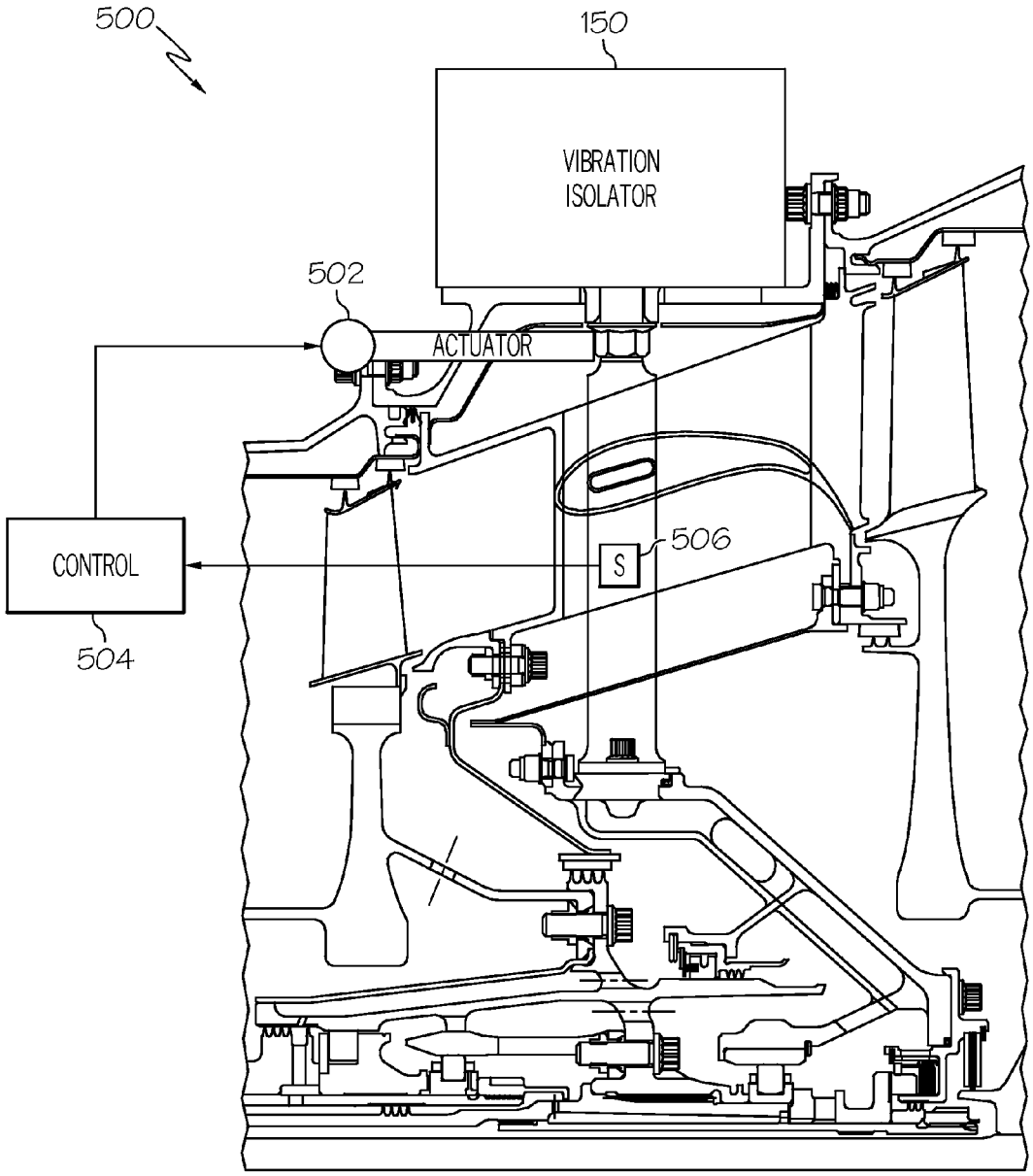
FIGS. 5-7 depict various embodiments of active gas turbine engine rotor tip clearance and shaft dynamics systems.
Figure 6:
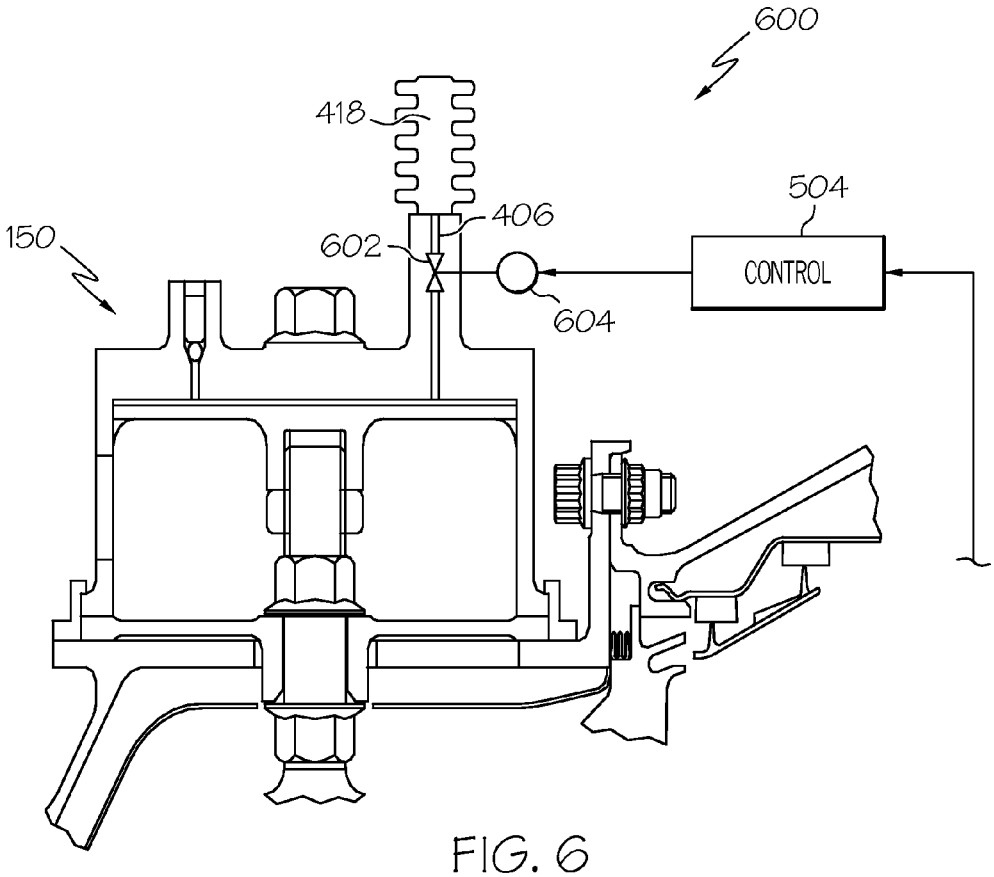
Figure 7:
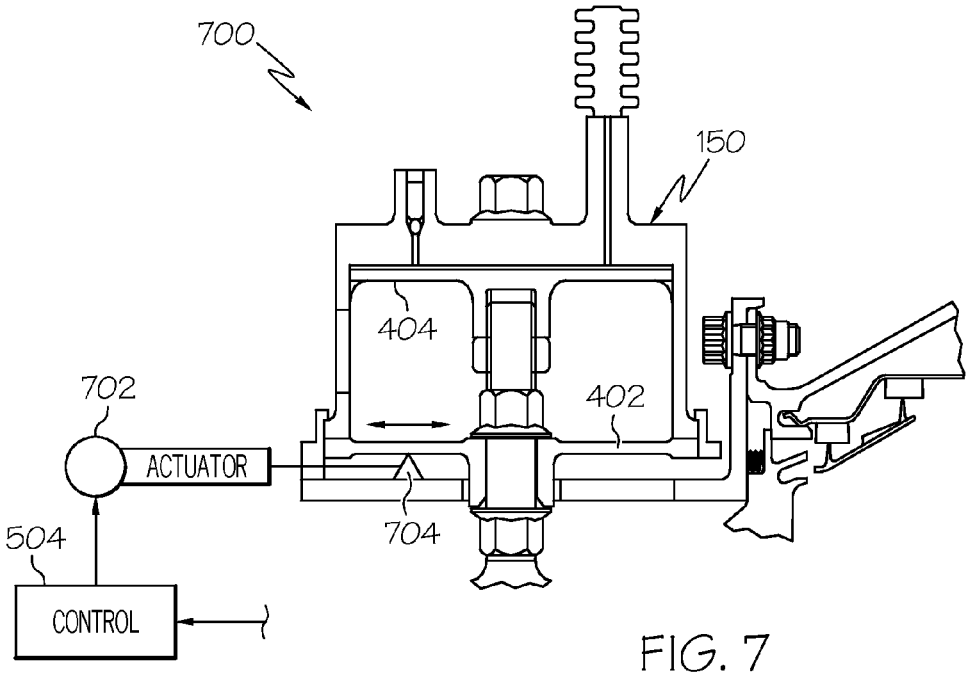

Various exemplary embodiments of active gas turbine engine rotor tip clearance and shaft dynamics systems are depicted in FIGS. 5-7 and will now be described. Before doing so, it is noted that for ease of illustration and description only one vibration isolator 150 and associated active control components are depicted. Preferably, however, suitable active control components (e.g., actuators, sensors, etc.) will be associated with each vibration isolator 150 on the engine 100.

Turning first to FIG. 5, the depicted active gas turbine engine rotor tip clearance and shaft dynamics system 500 includes, in addition to the devices, systems, and components already described, an actuator 502, a control 504, and one or more sensors 506. The actuator 502, which may be implemented using any one of numerous types of pneumatic, hydraulic, and electromechanical actuators, is coupled to at least one of the adjustment devices 410. In the depicted embodiment the actuator 502 is coupled to the lower adjustment device 410-1, but it could alternatively be coupled to the upper adjustment device 410-2 or to both devices 410-1 and 410-2. In any case, in this embodiment one or both of the adjustment devices 410 include relatively fine pitch threaded features. The actuator 502, in addition to being coupled to the adjustment device 410, is coupled to receive actuation control signals from the control 504. The actuator 502 is responsive to the actuation control signals it receives to rotate the adjustment device 410, and thereby actively control gas turbine engine rotor position and dynamics.

The control 504 is coupled to receive sensor signals from the sensor(s) 506 and is configured, in response to the sensor signals, to supply the actuation control signals to the actuator 502. Although the type, configuration, and placement of the sensor(s) 506 may vary, in the depicted embodiment the sensor(s) 506 is (are) implemented using one or more strain gauges, which are coupled to the strut 208 that couples the associated vibration isolator 150 to the rotor bearing assemblies 202, 204. With this configuration, during engine lateral acceleration, the one or more sensors 506 on the strut 208 on one side of the engine 100 will sense a load shift toward tension, while the one or more sensors 506 on the strut 208 on the other side of the engine 100 will sense a load shift toward compression. The sensor signals would result in the control 504 supplying actuator commands to the appropriate actuators 502 to move in opposite directions, and thereby center the rotors 134, 136.

In another embodiment, which is depicted in FIG. 6, the orifice 406 is actively controlled. To implement this functionality the active system 600 includes, in addition to the control 504 and one or more sensors 506 described above, a valve 602 and a valve actuator 604. The valve is disposed in the orifice 406 and is movable between an open position and a closed position. In the open position, hydraulic fluid 418 may flow through the valve 602, whereas in the closed position hydraulic fluid may not flow through the valve. The valve actuator 604, which may be implemented using any one of numerous types of pneumatic, hydraulic, and electromechanical actuators, is coupled to the valve 602, and is also coupled to receive actuator control signals from the control 504. The valve actuator 604 is responsive to the actuation control signals it receives to move the valve 602 between the open and closed positions.

With the system 600 depicted in FIG. 6 the valve 602 is configured to normally be in its open position, and thereby allow the flow of hydraulic fluid 418. During various aircraft maneuvers, the control 504, in response to the sensor signals supplied from the one or more sensors 506 (not depicted in FIG. 6), may supply actuator commands to the valve actuator 604 that cause the valve actuator 604 to move the valve 602 to its closed position. As a result, the damper mechanism 312 (see FIG. 3) is locked, enabling both the first and second linear spring mechanisms 306, 308 to actively control rotor position, rather than only the first linear spring mechanism 306. When the maneuver event is over, the control 504 will command the valve actuator 604 to move the valve 602 back to its open position, effectively removing the second linear spring mechanism 308 from low frequency participation, and again providing damping near critical speeds.

Another active gas turbine engine rotor tip clearance and shaft dynamics system 700 is depicted in FIG. 7. This system 700 is configured to address the scenario where the engine 100 may be shut down during flight, but may end up windmilling at an indeterminate speed during the remainder of the flight. More specifically, the system 700 is configured to adjust the rotor critical speed to avoid undesired vibration at intermediate windmilling speeds. Although the specific configuration of the system 700 may vary, in the depicted embodiment the system 700 includes, in addition to the control 504 and one or more sensors 506 (not depicted in FIG. 7) described above, an actuator 702 and an adjustable fulcrum 704. The actuator 702, which may be implemented using any one of numerous types of pneumatic, hydraulic, and electromechanical actuators, is coupled to the adjustable fulcrum 704 and is also coupled to receive actuator control signals from the control 504. The actuator 702 is responsive to the actuation control signals it receives to move the adjustable fulcrum 704 to a position.

The adjustable fulcrum 704 is disposed in the vibration isolator housing assembly 408, and engages the housing assembly 408 and one of the flexural members 402 or 404. In the depicted embodiment, however, the adjustable fulcrum 704 engages the first flexural member 402. The adjustable fulcrum 704 is movable, in response to the actuator 702, relative to the housing assembly 408 and the first flexural member 402. As may be appreciated, controlling the position of the adjustable fulcrum 704 on the first flexural member 402 will concomitantly control the stiffness of the first flexural member 402.

It is noted that the one or more sensors 506 in this system 700 preferably include one or more vibration sensors and one or more speed sensors. Moreover, the control 504 preferably generates the actuator commands using control algorithms based in an awareness of sensed rotor speed and vibration levels. The control algorithms are implemented to optimally position the critical speed in an active way by continuously sensing the vibration and speed.

With the system 700 depicted in FIG. 7, if an upward critical speed adjustment is needed, the control 504 will command the actuator 702 to move the adjustable fulcrum 704 to a position that will shorten the distance between the first flexural member's load point and the adjustable fulcrum 704, and thereby stiffen the first flexural member 402. Conversely, when a downward critical speed adjustment is needed, the control 504 will command the actuator 702 to move the adjustable fulcrum 704 to a position that will increase the distance between the first flexural member's load point and the adjustable fulcrum 704, and thereby soften the first flexural member 402.

In addition to passively or actively controlling engine rotor tip clearance and shaft dynamics, the configuration of the vibration isolators 150 enables the rotor centerline to be precisely located via adjustment devices 410. This may be accomplished by use of tooling or specific measurements during assembly. For example, after the precise location of the rotor is determined and achieved, the rotor may be locked in place via the adjustment devices 410. This effectively removes all the geometric tolerances otherwise impacting the position of the rotor within the engine casing 122. Improved engine efficiency, due to reduced operating clearances, and reduced manufacturing costs, due to the extremely close tolerances on multiple parts, are achieved along with optimal rotor dynamics.

The vibration isolators 150 depicted and described herein alleviate the need for traditional squeeze film dampers and simplifies the design in the vicinity of the bearings. The vibration isolators 150 have been proven to be extremely linear, and to precisely match an optimized design goal across relatively broad ranges of load, displacement, speed and temperature. The "roll-off," which can be thought of here as the rate of decrease in displacement transmissibility as a function of speed above critical speed, approaches that of an un-damped system, allowing reduced vibration at rotor speeds above the critical speeds. However, at transient speeds near critical speeds, where damping is desired, the vibration isolator 150 provides relatively high levels of linear damping.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A gas turbine engine rotor tip clearance and shaft dynamics system, comprising:

an engine case;

a gas turbine engine disposed within the engine case, the gas turbine engine including a rotor;

a rotor bearing assembly disposed within the engine case and rotationally mounting the gas turbine engine rotor therein;

a plurality of vibration isolators mounted on the engine case and coupled to the rotor bearing assembly, each vibration isolator configured to provide linear and independently tunable stiffness and damping, each of the vibration isolators comprising a plurality of adjustment devices adjustably coupling the vibration isolator to the rotor bearing assembly;

a plurality of actuators, each actuator coupled to at least one adjustment device in one of the vibration isolators and coupled to receive actuation control signals, each actuator responsive to the actuation control signals it receives to move the at least one adjustment device and thereby actively control gas turbine engine rotor position and dynamics; and an actuator control operable to selectively supply the actuation control signals to each actuator.

2. The system of claim 1, further comprising:

support structure coupled to, and extending between, each vibration isolator and the rotor bearing assembly.

3. The system of claim 2, wherein:

the gas turbine engine includes a turbine section having a gas flow path; and the support structure traverses the gas flow path.

4. The system of claim 1, wherein each vibration isolator comprises:

a first load path coupled between the rotor bearing assembly and the engine case, the first load path comprising a first linear spring mechanism; and a second load path disposed in parallel with the first load path and coupled between the rotor bearing assembly and the engine case, the second load path comprising a second linear spring mechanism connected in series with a damper mechanism.

5. A gas turbine engine rotor tip clearance and shaft dynamics system, comprising:

an engine case;

a gas turbine engine disposed within the engine case, the gas turbine engine including a rotor;

a rotor bearing assembly disposed within the engine case and rotationally mounting the gas turbine engine rotor therein; and a plurality of vibration isolators mounted on the engine case and coupled to the rotor bearing assembly, each vibration isolator configured to provide linear and independently tunable stiffness and damping;

a plurality of actuators, each actuator coupled to one of the vibration isolators and coupled to receive actuation control signals, each actuator responsive to the actuation control signals it receives to actively control gas turbine engine rotor position and dynamics; and an actuator control operable to selectively supply the actuation control signals to each actuator, wherein:

each vibration isolator comprises an orifice through which fluid may selectively flow, the orifice configured to implement a damping mechanism;

each vibration isolator further comprises a valve disposed in the orifice and movable between an open position and a closed position; and each actuator is coupled to the valve and is responsive to the actuation control signals to move the valve between the open position and the closed position.

6. The system of claim 5, further comprising:

support structure coupled to, and extending between, each vibration isolator and the rotor bearing assembly.

7. The system of claim 6, wherein:

the gas turbine engine includes a turbine section having a gas flow path; and the support structure traverses the gas flow path.

8. The system of claim 5, wherein each vibration isolator comprises:

a first load path coupled between the rotor bearing assembly and the engine case, the first load path comprising a first linear spring mechanism; and a second load path disposed in parallel with the first load path and coupled between the rotor bearing assembly and the engine case, the second load path comprising a second linear spring mechanism connected in series with a damper mechanism.

9. A gas turbine engine rotor tip clearance and shaft dynamics system, comprising:

an engine case;

a gas turbine engine disposed within the engine case, the gas turbine engine including a rotor;

a rotor bearing assembly disposed within the engine case and rotationally mounting the gas turbine engine rotor therein; and a plurality of vibration isolators mounted on the engine case and coupled to the rotor bearing assembly, each vibration isolator configured to provide linear and independently tunable stiffness and damping;

a plurality of actuators, each actuator coupled to one of the vibration isolators and coupled to receive actuation control signals, each actuator responsive to the actuation control signals it receives to actively control gas turbine engine rotor position and dynamics; and an actuator control operable to selectively supply the actuation control signals to each actuator, wherein:

each vibration isolator comprises a flexural member;

each vibration isolator further comprises a movable fulcrum that engages the flexural member at a fulcrum position; and each actuator is coupled to the movable fulcrum and is responsive to the actuation control signals to move the movable fulcrum to a commanded fulcrum position.

10. The system of claim 9, further comprising:

support structure coupled to, and extending between, each vibration isolator and the rotor bearing assembly.

11. The system of claim 10, wherein:

the gas turbine engine includes a turbine section having a gas flow path; and the support structure traverses the gas flow path.

12. The system of claim 9, wherein each vibration isolator comprises:

a first load path coupled between the rotor bearing assembly and the engine case, the first load path comprising a first linear spring mechanism; and a second load path disposed in parallel with the first load path and coupled between the rotor bearing assembly and the engine case, the second load path comprising a second linear spring mechanism connected in series with a damper mechanism.

* * * * *